United States Patent [19]

Stefanoni et al.

[11] 4,346,853

[45] Aug. 31, 1982

[54] UNWINDING MACHINE

[76] Inventors: Romano Stefanoni, Via Fiume 10, Nova Milanese (Milano); Eliseo Annoni, Via Fratellanza 4, Bollate (Milano), both of Italy

[21] Appl. No.: 176,560

[22] Filed: Aug. 8, 1980

Related U.S. Application Data

[63] Continuation-in-part of Ser. No. 70,824, Aug. 29, 1979, abandoned.

[51] Int. Cl.[3] ..... B65H 19/18; B65H 19/20

[52] U.S. Cl. ..... 242/58.1; 156/159; 156/504; 242/56 R

[58] Field of Search ..... 242/56 R, 58.1, 58.2, 242/58.3, 58.4; 156/157, 159, 502, 504

[56] References Cited

U.S. PATENT DOCUMENTS

| | | | |
|---|---|---|---|
| 3,841,944 | 10/1974 | Harris | 156/159 |
| 3,880,698 | 4/1975 | Kawazura | 242/58.4 |
| 3,974,490 | 8/1976 | Mori | 242/58.1 |
| 4,170,506 | 10/1979 | Marschke | 242/58.1 |

*Primary Examiner*—Edward J. McCarthy
*Attorney, Agent, or Firm*—Martin Smolowitz

[57] ABSTRACT

An unwinding machine for adhesive tapes comprising a frame on which two tape reels are mounted and successively unwound by independent driving means outside the machine. Each of the reels is associated with a driven launching roller and the launching roller is displaced away from the tape being unwound from the operative roller whereas the launching roller associated with the spare reel which is at rest, is operated to engage the end of the tape therefrom to unwind the tape and bring the spare reel up to speed when the tape on the operative reel is approaching the end thereof. First and second rollers are provided for each reel adjacent the path of the tape from the respective reel to the location outside the machine, the rollers defining two opposed straight travel sections for the tape. Cutters and pressing members are associated with each of the rollers so that the first cutter associated with the operative reel being unwound and the second cutter associated with the spare reel are simultaneously operated when the speeds of the two reels are the same for cutting the tape of the operative reel being unwound and the tape of the spare reel leading to the launching roller while at the same time, joining the cut ends of the tape along a portion of the travel section by the pressing members.

10 Claims, 1 Drawing Figure

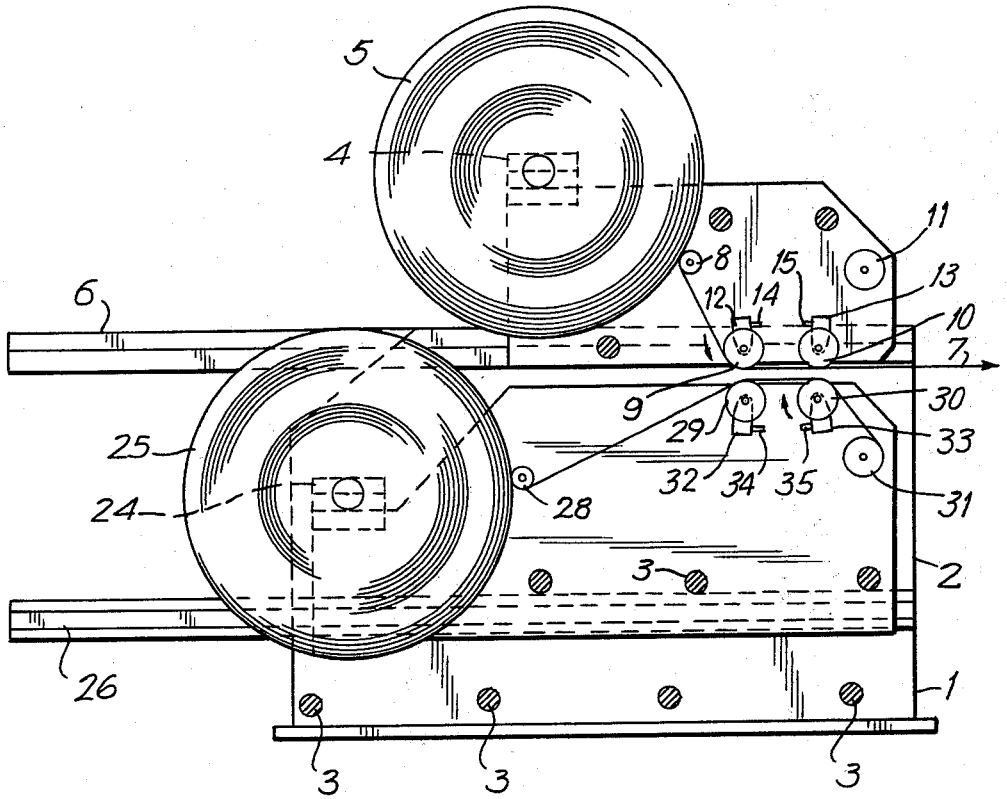
5
4
11
8
15
13
6
12
14
10
7
9
30
29
33
25
32
34
35
31
24
28
3
2
26
1
3
3
3

UNWINDING MACHINE

CROSS-RELATED APPLICATION

This application is a continuation-in-part of Ser. No. 70,824 filed Aug. 29,1979, abandoned.

FIELD OF THE INVENTION

This invention relates to an unwinding machine for tapes, and more particularly tape films, preferably previously rendered adhesive on at least one face thereof.

BACKGROUND

When producing adhesive tapes of different sizes, it is necessary to start from film reels of relatively large diameter, which are then unwound, cut to measure and rewound in suitable cutters.

Due to the high speed of these machines, the shutdown times for replacing the empty reel and joining with the already unwound end weigh heavily on the total costs of the finished product.

Machines are known which are provided with two reels which are alternately unwound by independent unwinding means, requiring a shutdown only for the time to provide for joining the unwound end or terminal and the start of the spare reel. The empty reel can then be replaced during the unwinding of the spare reel. However, these machines require a shutdown and moreover the connection has to be made with the machine at rest.

SUMMARY OF THE INVENTION

It is an object of the present invention to provide an unwinding machine for tapes or tape films, preferably with an adhesive applied thereto, capable of automatically effecting the connection between the tape of a reel which is about to run out and that of another reel, hereinafter referred to as a spare reel, without shutting down or stopping the machine.

It is a further object of the invention to provide a machine which has a joining means comprising a superimposed section of greatly reduced length, devoid of folds and accordingly not liable to discards in the rolls of finished tape that will be issued from the cutter.

BRIEF DESCRIPTION OF THE DRAWING

The invention will now be explained with reference to the sole FIGURE of the accompanying drawing which is a schematic side view of a preferred but not limiting embodiment of the inventive machine.

DETAILED DESCRIPTION

A machine 1 comprises two standards or uprights 2 (only one being visible in the form of opposed plates which are connected by tie rods 3. Two openable upper bearings 4 (only one being visible in the drawing) carry the top reel 5 and are mounted on upper guides 6 to aid in loading and unloading of the reel. Similarly, two openable lower bearings 24 carry a bottom reel 25 and are mounted on lower guides 26.

An unwinding means for the top reel 5 comprises an upper reaction roller 8 and two smooth idle rollers 9 and 10, referred to as first and second upper rollers, respectively.

In the drawing, a tape 7 is shown which is unwound from reel 5 and, by passing beneath rollers 8,9 and 10, is carried to a winding operation on another reel (not shown). An upper launching roller 11, to be discussed later, is connectable to the machine motor, and is spaced from the tape 7 being unwound from reel 5.

Similarly, at the bottom of the machine there are provided a reaction roller 28, a first lower knurled idle roller 29 and a second knurled idle roller 30, as well as a lower launching roller 31, which is also connectable to the machine motor.

Under the operative condition shown, the reel 5 is being unwound and tape 7 is rewound on a suitable shaft, while reel 25 is at a standstill and serves as a spare reel. The pairs of smooth and knurled idle rollers 9,10 and 29,30 define two planar, parallel and opposed path sections at the tape outlet from the machine, separated by a certain distance, and the tape end of reel 25 is attached to the launching roller 31.

The smooth rollers 9 and 10 and knurled rollers 29 and 30 have cutting and pressure units associated therewith, comprising eccentric pressers 12,13,32 and 33, having blades or other cutting devices 14,15,34 and 35 mounted thereon.

During the operation of the machine, said cutting and pressure units are disconnected from the rollers and held at rest remote from the tapes as shown in the drawing. When a suitable sensor or counter for the diameter of the moving reel 5 detects a preset value indicating that the tape on reel 5 is near its end, the launching roller 31 is operated and causes reel 25 to rotate. Said sensor may, for example, be a photoelectrical type of detector mounted at bearings 4 to receive a reflected light beam impinging on the reel body. A suitable speed sensor or detector, for example, a speedometer dynamo, determine when the running driving speed has been attained, that is when the tape driven by roller 31 has the same speed as tape 7 and simultaneously operates said cutting and pressing units 12,14 and 33,35.

The above mentioned unit 12,14 rotates in the direction shown by the arrow to cut the tape 7 and at the same time to press it against the tape from reel 25, to which it becomes attached.

Similarly, the rotation of unit 33,35 produces cutting of the tape from reel 25 separating it from the launching roller 31 and pressing it against tape 7 to connect it to the latter.

The suitable timing of these operations and the width of the pressure sectors, depending on the driving speed, are such to provide the complete joinder between the tapes of the two reels for a section of a length considerably less than the spacing between the axes of rollers 9,10 or 29,30.

Now, the reel 25 is unwound by the driving action of the outgoing tape and reel 5 is stopped. During the unwinding of reel 25, the following operations are carried out in order to preset the machine for a subsequent reel change: opening of bearings 4 and withdrawal of the empty reel by sliding on the guides 6 (or complete replacement of the bearing assembly with an already preset assembly); partial unwinding of the tape on the new reel to attach or anchor it to the launching roller 11, and possible removal from the launching roller 31 of the tape still wound up thereon.

On approaching the end or exhaustion of reel 25, a corresponding sensor will operate the launching roller 11 and a further detector will control the operation of units 13,15 and 32,34, similarly as herein above described. The pneumatically controlled reaction rollers 8 and 28 are pneumatically controlled and perform an anti-tearing and anti-hoise function avoiding tearing of the rolled up tape.

The launching rollers are knurled for an improved adhesion of the tape, while the rollers 9 and 10 are preferably smooth and the rollers 29 and 30 are preferably knurled for facilitating the separation thereof from the tape bearing thereon by the adhesive side. The cutting control is of electrical type, comprising a temporally adjustable control pulse for final setting up.

The cutting and pressing units may be independent of the rollers, or interlocked thereto at the time of use and released immediately after a complete revolution.

Finally, the machine could be used also for tapes which have not been made adhesive and in such a case it would suffice to provide suitable adhesive or bonding agent spreaders at the rollers, operated by the same control for the cutting and pressing units.

Although the invention has been described with reference to a specific embodiment, the invention is understood as not being limited to the latter, and changes and modifications will appear to those skilled in the art which are within the scope of the invention as defined in the appended claims.

What is claimed is:

1. An unwinding machine for adhesive tapes comprising a frame, two rotatable tape reels on said frame for successive unwinding of tape therefrom, a driving launching roller for each reel, one reel being unwound by pulling on the tape from a location outside the machine while the other reel serves as a spare and is at rest, the driving launching roller associated with the spare reel being operated to engage the end of tape therefrom to unwind the tape from the spare reel when the tape on said one reel is approaching the end thereof, first and second rollers for each reel adjacent the path of the tape from the respective reel to the location outside the machine, said first and second rollers for the reels defining two opposed straight travel sections, and cutting means with eccentric pressing members associated with said first and second rollers such that the cutting means associated with the first roller of the reel being unwound and the cutting means associated with the second roller of the spare reel are simultaneously operated when the speeds of the two reels are the same to cause the tape from the reel being unwound to be cut while the tape leading to the launching roller from the spare reel is cut while simultaneously the cut end of the tape from the spare wheel is joined to the cut end of the tape extending to the location outside the machine, the joinder being effected in said travel section by said eccentric pressing members.

2. A machine as claimed in claim 1 wherein said cutting means and pressing units each comprises a portion of circular sector at the periphery of the respective roller and a cutting member on said portion.

3. A machine as claimed in claim 1 wherein one pair of said first and second rollers are smooth and the other pair of said first and second rollers are knurled.

4. A machine as claimed in claim 3 wherein said launching rollers are knurled.

5. A machine as claimed in claim 4 wherein said first and second rollers associated with each reel rotate idly.

6. A machine as claimed in claim 1 comprising operable bearing means supporting each reel for allowing replacement of an empty reel with a full reel.

7. A machine as claimed in claim 6 wherein said reels are supported idly.

8. A machine as claimed in claim 1 wherein said launching rollers are movably mounted between a first position spaced from the tape from the associated reel and a second position in operative engagement with the tape to pull the same from the reel to bring the speed thereof up to that of the reel being unwound.

9. A machine as claimed in claim 1 wherein the cutting means associated with the first and second rollers of each reel are operated in alternation according to whether the associated reel serves as a spare reel or as a supply reel for tape outside the machine.

10. A machine as claimed in claim 9 wherein the alternate operation of the cutting means is effected in alternation for the two pairs of rollers so that the cutting and joinder of the tapes is effected at an axial location between said pairs of rollers.

* * * * *